US007448814B2

(12) United States Patent
Bouix et al.

(10) Patent No.: US 7,448,814 B2
(45) Date of Patent: Nov. 11, 2008

(54) COSMETIC DISPENSING DEVICES CONTAINING HEATING ELEMENTS

(75) Inventors: Herve Bouix, New York, NY (US); Christophe Jacob, Rouen (FR)

(73) Assignee: ELC Management LLC, New York, NY (US)

( * ) Notice: Subject to any disclaimer, the term of this patent is extended or adjusted under 35 U.S.C. 154(b) by 76 days.

(21) Appl. No.: 11/422,711

(22) Filed: Jun. 7, 2006

(65) Prior Publication Data

US 2007/0286666 A1 Dec. 13, 2007

(51) Int. Cl.
*A46B 11/08* (2006.01)
*A47L 13/32* (2006.01)
*B43M 1/02* (2006.01)

(52) U.S. Cl. ..... 401/2

(58) Field of Classification Search ..... 401/1, 401/2

See application file for complete search history.

(56) References Cited

U.S. PATENT DOCUMENTS 2,488,591 A * 11/1949 Fevas ..... 601/17
4,291,685 A 9/1981 Taelman
4,465,073 A 8/1984 Schwob
4,597,684 A * 7/1986 O'Brien et al. ..... 401/197
4,889,440 A * 12/1989 Shano ..... 401/1
5,395,175 A 3/1995 Bontoux et al.
5,556,468 A 9/1996 Legrain et al.
5,831,245 A 11/1998 Debourg et al.
5,851,079 A * 12/1998 Horstman et al. ..... 401/174
7,126,094 B2 * 10/2006 Bower et al. ..... 219/544

* cited by examiner

*Primary Examiner*—Huyen Le
(74) *Attorney, Agent, or Firm*—Peter Giancana

(57) ABSTRACT

An improved heated, integral applicator for flowable cosmetic and dermatologic products comprising flexible printed circuits and, optionally, flexible heater technology. The present invention is safer to use and has more reliable electronics than the prior art; is more convenient to use and carry; is capable of precise dosing; is simpler and cheaper to manufacture and assemble; offers special applicator tips for precise application of treatment and makeup products. The present invention is useful for applying cosmetic and dermatologic treatment products of all types, including products to treat skin, hair and nails. Suitable skin treatment products include those effective at deeper layers of the skin.

23 Claims, 8 Drawing Sheets

COSMETIC DISPENSING DEVICES CONTAINING HEATING ELEMENTS

FIELD OF THE INVENTION

The present invention pertains to liquid product dispensers that heat a portion of product as it is being dispensed from a cosmetic applicator and/or as it is being applied to a surface. Generally, devices according to the present invention create opportunities for improving product performance, enhancing consumer experience and expanding formulary options, while overcoming disadvantages of prior art heating applicators.

BACKGROUND OF THE INVENTION

Product applicators are designed to deliver a quantity of product to a target surface. In consumer goods there are, broadly, two types of applicators. There are applicators that are separable from a product container/reservoir and there are applicators that are integral with a product reservoir. A "separable applicator" is one that is disconnected from a product reservoir at the time of applying product to a target surface. In use, a separable applicator is loaded with product from a product reservoir for transfer to a target surface. In contrast, applicators that are integral with a product reservoir (herein, "integral applicators") cannot be separated from the product reservoir. An integral applicator may be thought of as having a reservoir portion and an applicator portion. This type of device dispenses product by causing the product to flow from the reservoir, through the interior of the applicator portion, out an exit structure onto an exterior surface of the applicator portion, from where the product may be transferred to a target surface.

Either applicator type is known to be coupled with a heating element to raise the temperature of a product prior to and/or during dispensing and application. However, these two types of applicators have different strengths and weaknesses, different design and use issues, and different problems associated with incorporating heating means into their respective interiors. Therefore, a heated integral applicator has different issues than a heated separable applicator, as now briefly discussed.

Heating means may be added to a separable applicator in one of two ways. In the first case, the heating means is associated with the reservoir. The disadvantages of this include subjecting all of the product in the reservoir, or at least more than will be used, to repeated temperature cycles, possibly damaging the product. Also, heat is lost in the time it takes to transfer the product from the reservoir to the target surface. Also, it will generally take longer to raise the temperature of the product to application temperature because more is being heated. In the second case, the heating means is associated with the applicator. The disadvantages of this include the need to house the electronic circuitry and heating means solely within the applicator. This is a serious problem in cosmetics and personal care applicators which tend to be sleek and designed for easy storage in a small purse or pocket. In the personal care field, often the drive is to make applicators smaller and more convenient, not bulkier. Therefore, when the addition of heating components to an applicator requires making the applicator larger, this is a clear disadvantage.

In contrast, to incorporate heating means, integral applicators do not have to be enlarged at all or to the same degree as separable applicators. Some of the disadvantages of heated separable applicators are overcome in a dispensing container with integral applicator because the heat can be generated in the applicator portion, while the electronics can be housed within the container/reservoir portion. Thus, only the product being dispensed is heated and there is no need to enlarge the applicator. The container portion provides sufficient space for a layout of electric circuits and comparatively little of the circuitry is housed within the applicator portion. Thus, integral applicators with heating means may be no larger than integral applicators having no heating means. Integral applicators that heat a product prior to or at the time of dispensing are known. Specifically, there are such devices in the fields of cosmetics and personal care. The following will make clear the shortcomings of known devices of this type.

U.S. Pat. No. 4,291,685 discloses a handheld cosmetic applicator "for applying heat and medicament, unguents, cosmetics and the like to the face or other parts of the body." The applicator comprises a dispensing means that consists of a plunger that is slidable within a hollow interior of a tubular handle. The plunger is moved by the action of a user's thumb against an actuator that slides in a slot in the handle. The disadvantage of the plunger is that it is difficult to control the amount of product dispensed and the rate at which it is dispensed. Therefore, product heating may be uneven from dose to dose. Also, the plunger takes up space inside the reservoir. Furthermore, the '685 device is unsuitable for products that flow, either at ambient temperatures or after being heated. Liquids would leak from the '685 device, out the exit orifices because no means of containing the product is disclosed. Also, the sliding plunger mechanism is not an efficient means of dosing a flowable liquid because the amount dosed would be difficult to control. Clearly, the '685 device should not be used with liquid products that readily flow at ambient temperatures or that flow after being heated.

In the '685 device, the heating means includes an electrically resistive element, an electrical cord connected to a rheostat and a plug for connecting to an electrical power source. Thus, this device relies on ordinary household current and a rheostat to adjust the electrical current that is delivered to the resistive element. Disadvantages of the prior art electrical system include the following: electrical cords tend to deteriorate and be unwieldy; the plug-in power cord does not offer the mobility and safety of batteries; the voltage used is much higher than that of batteries; the internal circuitry consists of extended runs of wiring which is difficult and costly to assemble into the housing, compared to a prefab, printed circuit board; the device has user activated on-off switches, which means that the device may be left on, unintentionally.

Furthermore, the '685 prior art device is intended to contact the skin for an extended time. Hence, a need for the consumer to be able to control temperature via a variable rheostat. The rheostat control is in the form of "a sleeve mounted for rotatable movement around the outer periphery of said handle for controlling said rheostat." The need to include a rheostat is a potential disadvantage of the prior device. The rheostat design is complex and adds bulky electronics to the device and their associated costs. The rheostat creates an unsuitable appearance for a cosmetic applicator. The rheostat may be moved accidentally during use. The rheostat adds size, bulk and cost to the device.

Furthermore, this device offers a vibrating massage effect when contacting the body. To achieve the massage effect, the vibrating application surface, where dispensed product accumulates before application, is flat and extended. A disadvantage of the extended application surface is that the product application is not precise, because product is spread out over the extended surface. Such a surface is unsuitable for applying product to any relatively small area requiring a confined dose of product, for example, to the eye area. Furthermore, the relatively large application surface and the massaging vibration work a product crudely into the skin. In contrast, various personal care products for making up or care of the skin should not be applied in a crude manner. They should be applied with precision and care, targeted to each specific area. Clearly, the '685 prior art device is not suitable for use as a targeted personal care applicator and other massage devices would suffer from similar drawbacks.

Furthermore, the flat application surface is smooth or textureless and relatively hard. A softer surface would render the '685 device inoperative, or at least less effective, by damping the massage vibration. A textured vibrating surface may irritate the skin. For these reasons, this prior art device should not be provided with a foam or flocked application surface. Not having a flocked or foamed tip is a drawback of the prior art, because a flocked or foamed tip provides a soft and luxurious product application.

All of this is in contrast to the present invention, wherein: there is no plunger to take up space; there are no or few electrical cords; the device is much less likely to be left on unintentionally and even if it is, it would only continue at a relatively low voltage until the batteries drained, thus it is safer; there is no need for a rheostat; the applicator surface is suitable for precise dosing to a targeted area; the applicator surface my be textured or flocked or otherwise provided with any sort of feel; the applicator is suitable for flowable products, without leaking. To the extent that prior art devices share one or more characteristics of the '685 device, they too are inferior to the present invention.

There are a large number of devices for applying a wax or thermoplastic material to the skin. Examples include those disclosed in U.S. Pat. Nos. 5,395,175; 5,556,468; and 5,831,245. Generally, in devices of this type the product to be applied to the skin is substantially solid at room temperature. To achieve flowability, the product must be heated while it is still in the reservoir. Heating the entire reservoir has the disadvantage of subjecting the entire contents of the container to repeated temperature cycles. Therefore, this kind of applicator is clearly only suitable for products that are not substantially affected by temperature cycling, i.e. some waxes. In contrast, many cosmetic and dermatologic products are unstable when subjected to temperature cycling. For products that will be changed structurally or chemically by the application of too much heat or from being too often heated, these prior art devices are wholly unsuitable. Therefore, prior art devices that heat even a portion of the reservoir, or that heat more product than will be used, are unsuitable for many cosmetic applications.

Another disadvantage of devices that heat the reservoir, or that heat more product than will be used, is the power consumed. Far more power must be consumed by these devices because they aim to raise the temperature of a greater mass of product than the present invention. This is costly and inconvenient if batteries need to be replaced often. In acknowledging this problem, many of these prior art devices provide thermal insulation to keep the heat inside the reservoir. Of course, this adds complexity and cost. In some prior art devices, the power source is separate from the applicator and the applicator needs to be rejoined to the power source in order to heat the product. Such devices do not offer the convenience and portability of a self-contained cosmetic applicator.

All of this is in contrast to the present invention, wherein: the product remaining in the reservoir is not substantially heated and remains in good condition for future use; relatively little power is consumed; no thermal insulation is required; and the power source is integral with the applicator so that continuous heating and convenient portability are achieved.

U.S. Pat. No. 4,465,073 describes an appliance for wax depilation especially of the face. A nozzle having an external opening located at the tip of the outer casing of the appliance is intended to be held close to the user's skin. A heater adjacent to the duct melts the wax which is engaged within the duct. A plunger ("carriage") for receiving the block of wax within the appliance is intended to be pushed by hand towards the duct by means of an external thumb control button. This device does have the advantage that the wax in the reservoir is not directly heated because the heating means has been associated with the applicator portion of the device. However, like U.S. Pat. No. 4,291,685, above, this device relies on the action of a user's thumb against an actuator (or "carriage") to advance the product. The disadvantage of this is that it is difficult to control the amount of product dispensed and the rate at which it is dispensed. Therefore, product heating may be uneven from dose to dose. Also, the carriage mechanism is again unsuitable for readily flowable liquid products. Also, the plunger takes up space inside the reservoir. The heating means includes a thermistor, an electrical cord and plug for connecting to an electrical power source. Thus, this device relies on ordinary household current. Disadvantages of the prior art electrical system include the following: electrical cords tend to deteriorate and be unwieldy; the plug-in power cord does not offer the mobility and safety of batteries; the voltage used is much higher than that of batteries; the internal circuitry consists of extended runs of wiring which is relatively difficult and costly to assemble into the housing; it is easy to leave the device on when not in use.

All of this is in contrast to the present invention, wherein: there is no plunger to take up space; there are no or few electrical cords; the internal circuitry consists of a prefab, flexible, printed circuit which is relatively easy and inexpensive to assemble into the housing; the device is much less likely to be left on unintentionally and even if it is, it would only continue at a relatively low voltage until the batteries drained, thus it is safer; relatively little power is consumed; and the applicator is suitable for flowable products, without leaking.

OBJECTS

The main object of the present invention is to provide an improved heated, integral applicator for flowable cosmetic and dermatologic products.

Another object of the present invention is to provide an integral heating applicator that is safer to use and that has more reliable electronics than the prior art.

Another object is to provide an integral heating applicator that is more convenient to use, portable and less bulky.

Another object is to provide an integral heating applicator that is simpler to manufacture and assemble.

Another object is to provide an integral heating applicator that is sleek, having a small profile suitable for the cosmetics and personal care industry.

SUMMARY OF THE INVENTION

All of the foregoing and more are achieved with a cosmetic applicator that is integral with a product reservoir, the applicator having an elongated body that defines a reservoir that houses a cosmetic or dermatologic product for dispensing. A flow passage exists that extends from the reservoir to an exit structure, where product emerges from the dispensing device for transferring to the user's body. Means exist for urging product from the reservoir into the flow passage and out the exit structure. These means are controllable by the user. A compact, space-saving electronic heating means that is capable of connecting to a low voltage battery power source is located in or immediately adjacent to the exit structure. The heating means is situated so that product is heated only as it is about to exit the applicator, while product in the reservoir is not substantially heated. Preferably, the applicator incorporates flexile heater technology, but the full benefits of the present invention are only realized by the use of a modular, printed electronic circuit subassembly, which is compact and which is turned on and off by the removal and replacement of a closure. The closure also opens and closes the applicator orifice to control the flow of product. Electrical connections capable of transmitting low voltage electrical energy are provided in electrical contact with the heating element, power source and on-off means. The present invention is useful for applying cosmetic and dermatologic treatment products of all types, including products to treat skin, hair and nails. Suitable skin treatment products include those effective on the surface of the skin and those effective at deeper layers of the skin. These and other aspects of the invention will be discussed herein.

DETAILED DESCRIPTION OF THE INVENTION

Throughout this specification, the terms "comprise", "comprises", "comprising", "have", "has" and "having" and the like shall consistently mean that a collection of objects is not limited to those objects specifically recited.

Throughout this specification "readily flowable" means that, if allowed, a product will flow in response to its own weight.

Throughout this specification "effectively heating a product" means that the heating element housed in the applicator is sufficient, by itself, to impart to a product or a user, a full intended benefit or effect, secondary heating means not being needed. An example of an intended effect is to alter the temperature of a portion of product from a starting temperature to within a range of target temperatures.

Throughout this specification "activate a product" or the like means that heating a portion of product alters the portion of product to exhibit behavior that it did not exhibit just prior to being heated. "Activate a product" also means to alter (either enhancing or diminishing) one or more properties of the unheated product.

Throughout the specification "cosmetic" means any topical preparation, such as those mentioned above, that beautify, alter the appearance, provide a benefit to the surface to which they are applied or provide a benefit to the subject to which they are applied. "Cosmetic" includes dermatological, pharmaceutical and nutraceutical preparations.

Figure 1:
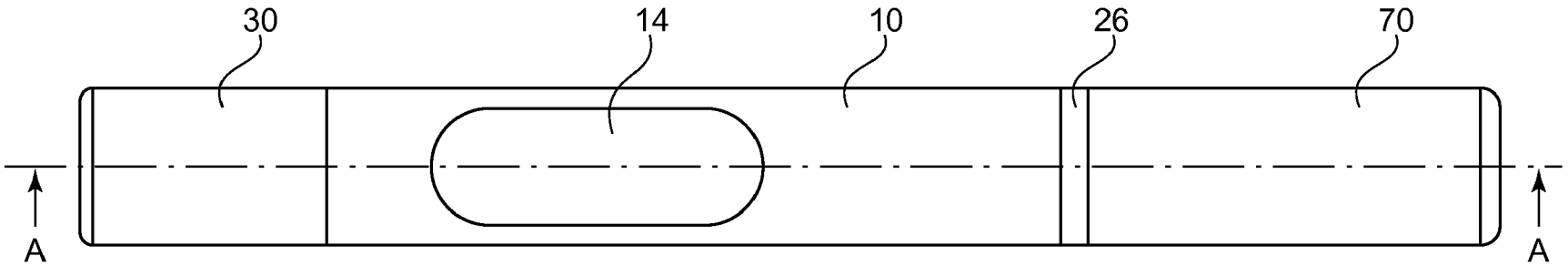
FIG. 1 is plan view of an applicator according to the present invention.
Figure 2:
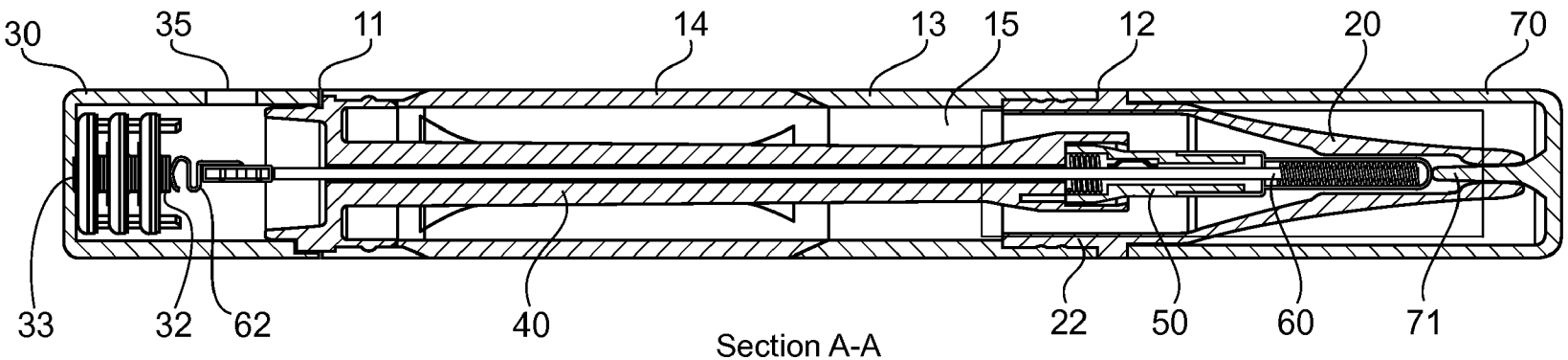
FIG. 2 is a cross section through line AA of FIG. 1.

FIGS. 1 and 2 provide a visual summary of the main features of an applicator according to the present invention. Element (10) is an elongated body; (20) is an applicator tip; (30) is a current source housing; (40) is a printed circuit housing; (50) is a switch assembly; (60) is a printed circuit subassembly, which includes a resistive heating element, and (70) is a closure.

The body (10) is shown in FIGS. 1 and 2 as basically cylindrical and opened at a first or proximal end (11), which makes it capable to receive the circuit housing (40). A second or distal end (12) of the body is opened to receive an applicator tip (20). The shape of the body is not limited to being cylindrical, but may be virtually any desired shape. The body wall (13) is preferably rigid, except for one or more flexible portions (14). The flexible portions of the body wall may be, for example, rubber or elastomer and are large enough to be pressed by one or more fingers of a user. FIG. 2 shows two flexible portions located on opposing sides of the body. The act of pressing on one or more flexible portions urges product out of the reservoir (15) and toward the exit orifice (23). The reservoir is the interior of the body and it holds a topical product. Optionally, the interior of the body may be divided into more than one reservoir, each reservoir containing a topical product, preferably not all the same topical product. In this case, for each reservoir there will be a flexible wall portion that when pressed, urges product from one specific reservoir. Preferably, the rigid portion of the body is unitary and molded with the flexible portions in a bi-injection molding process. Preferably, the rigid portion of the body is plastic. The exterior surface of the body is suitable for decorating in any known conventional manner.

The first end (11) of the body is configured to grip the circuit housing (40) and form a liquid tight seal therewith. This may be accomplished by providing snap-fitting features near the first end of the body such that the snap-fitting features are capable of engaging complementary features on the circuit housing. Likewise, the second end (12) of the body is configured to grip the applicator tip (20) and form a liquid tight seal therewith. This may be accomplished by providing snap-fitting features near the second end of the body such that the snap-fitting features are capable of engaging complementary features on the applicator tip. Other means of achieving liquid tight fittings are well known in the art.

Figure 3:
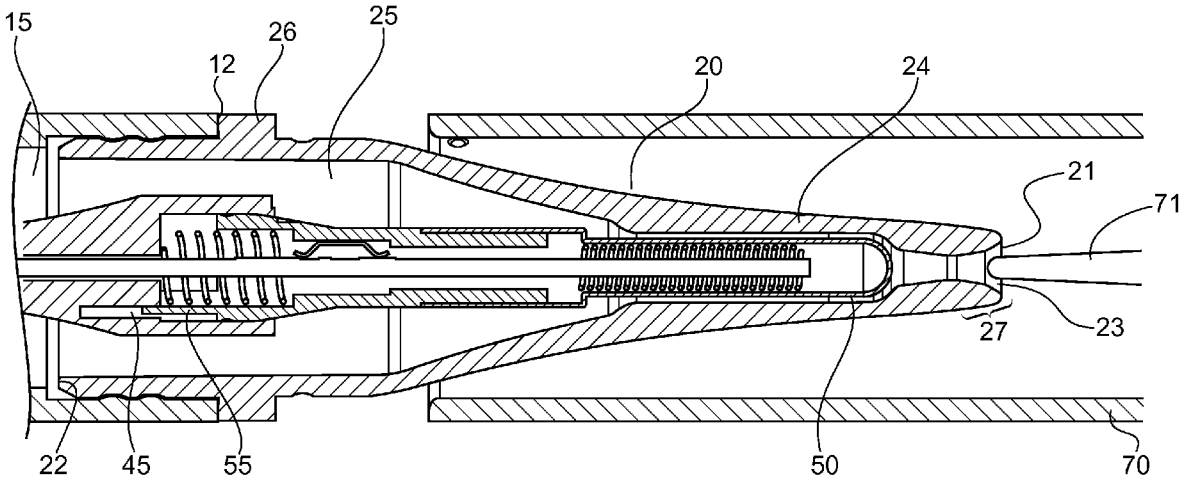
FIG. 3 is a cross section of the distal portion of an applicator according to the present invention, a portion of the closure also being visible.

Referring to FIG. 3, the applicator tip (20) has a first or proximal end (22) that that is designed to form a liquid tight seal with distal end (12) of the body (10). This may be accomplished by providing snap-fitting features near the proximal end of the applicator tip such that the snap-fitting features are capable of engaging complementary features on the body. The proximal end of the applicator tip is opened, which makes the applicator tip able to receive the circuit housing (40). The applicator tip is hollow, which creates a flow passage (25) from the reservoir (15) to the exit orifice (23), from which dispensed product emerges. The applicator tip has a second or distal end (21) that opens to form the exit orifice. The applicator tip as shown, has a generally conical shape, but this is not required. A distal portion (24) of the applicator tip may narrow, as shown. However, the hollow interior of the distal portion must be sufficiently large such that the switch assembly (50) can extend to substantially near the exit orifice where it can be reached by the pintel (71) of the closure (70) through to the exit orifice (more on this below). Optionally, the applicator tip may be provided with a shoulder (26) that sits against the distal end (12) of the body, when those elements are assembled. The shoulder may also or alternatively form a stop for the closure, when the closure is slipped over the applicator tip.

In one embodiment, product flows out the exit orifice (23) and directly onto a target surface, i.e. the skin. Alternatively, the applicator tip (20) may be provided with a "working portion" (27). The working portion of the tip is a part of the outer surface of the applicator tip that is immediately adjacent to the exit orifice. If provided, the working portion will generally be the portion of the tip that is used to convey product to an application surface. Therefore, the working portion may incorporate any features that facilitate that step. For example, consideration may be given to the shape of the working portion of the tip such that the working portion is shaped for applying cosmetic to a specific portion of the body: a relatively small working portion for application to the eye area; a working portion in the shape of a lipstick bullet for delivery of products to the lips; a relatively larger, extended flat surface for delivery of product to extended surfaces of the body, i.e. the arms and legs. A working portion of any useful shape may be used.

Another tip feature where variation is possible, is the texture of the working portion (27). The working portion may be smooth or textured to facilitate pick and delivery of product. Texture may be provided by treating the surface of the tip. For example, the tip may be overlaid with absorbent or exfoliating material. Flocking the tip is one example of providing an absorbent material that takes up more product from the reservoir than a naked tip, and can also facilitate application to the application surface. A sponge is another example. Alternatively, an exfoliating tip may be used so that at the time of application the heated product may better penetrate the skin. In this case, both the exfoliating action and the heat from the applicator work to open the pores of the skin to receive product at a deeper level. An exfoliating working portion may be provided by covering the working portion of the tip with an abrasive material or by molding a raised and embossed pattern into the tip itself.

The whole applicator tip (20) or any portion thereof, may be straight or curved. It may be beneficial to curve the whole tip if that shape facilitates delivery of product to a particular area of the body that would be harder to reach or harder to coat with product if the tip was not curved. For example, sometimes curved or arced applicators are used on the eyelids or eyelashes. By a curved applicator, it is meant that a central axis that passes through the interior of the applicator tip from distal end to proximal end, is curved.

The interior of the applicator tip (20) is in contact with heated product as the product is flowing through the applicator tip and being dispensed. Some of this heat will transfer into the applicator tip, where it may cause discomfort to a user and from where the heat will be lost to the ambient atmosphere. So that a maximum amount of heat remains in the dispensed product, it is preferable if the applicator tip does not readily conduct heat, Optionally, some portions of the applicator tip may be insulators of heat. By insulating the applicator tip, energy may be saved, the product may be heated more efficiently and the consumer may be spared any inadvertent or unwanted exposure to heat. One method of insulating may include making the wall of the applicator tip of a substantial thickness of plastic, to slow heat loss. The actual thickness will depend on the rate of heat generation and the particular material employed. This is readily determinable by routine experimentation. Materials that readily conduct heat may be less preferred for the applicator tip.

Figure 4:
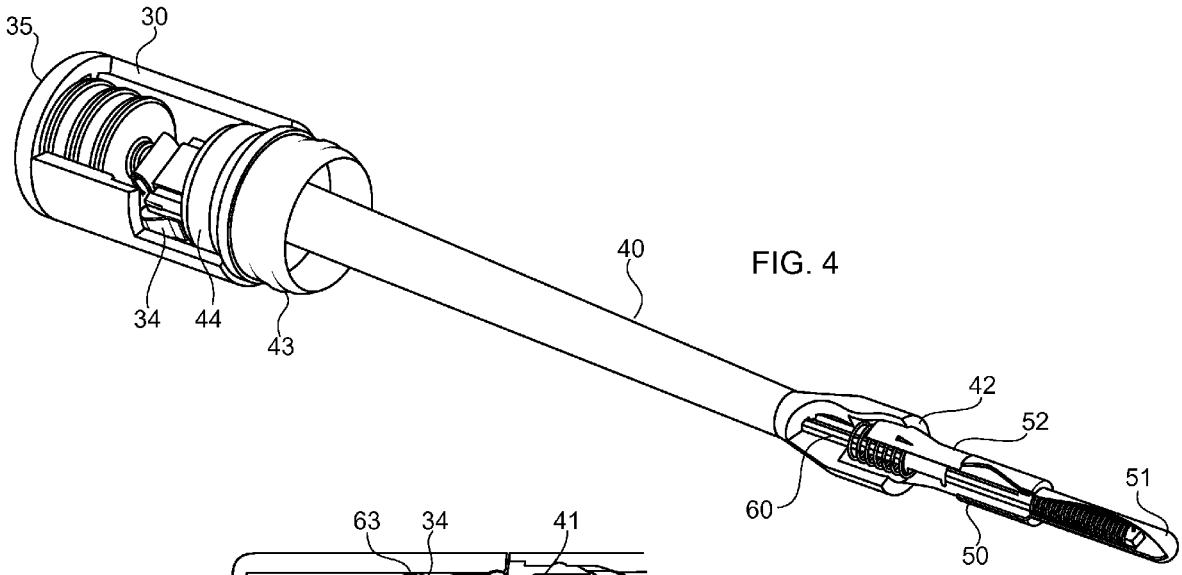
FIG. 4 is a perspective view of a subassembly of a circuit housing, a printed circuit, a switch assembly and a power source housing, with portions cut away.
Figure 5:
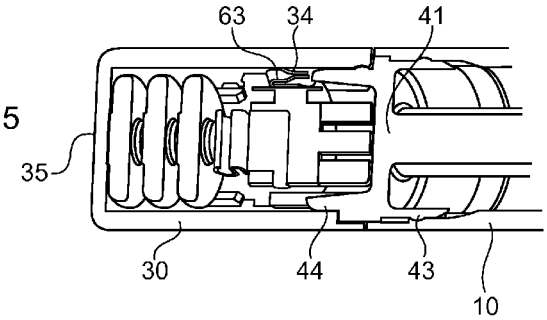
FIG. 5 shows one embodiment of the connections between the body, the circuit housing and the power source housing.

Referring to FIGS. 4 and 5, the printed circuit housing (40) is an elongated member that extends through the body (10) and into the applicator tip (20). A channel passes through the entire length of the circuit housing. The channel is capable of receiving the printed circuit (60). The channel opens onto a second or distal end (42) of the circuit housing. The opening at the distal end is sized to receive the piston (52) of the switch assembly (50). The circuit housing supports the printed circuit and partially shields it from contact with environment of the reservoir (15). A first or proximal end (41) of the circuit housing is configured to grip the body (10) and form a liquid tight seal therewith, as well as to attach to the current source housing (30). This may be accomplished by providing two sets of snap-fitting features near the first end of the circuit housing such that one set of snap-fitting features is capable of engaging complementary features on the body and the other set of snap-fitting features is capable of engaging complementary features on the current source housing. In the embodiment of FIG. 5, each set of snap-fitting features is provided on one of two annular flanges (43 and 44).

Referring to FIG. 5, the current source housing (30) attaches to the printed circuit housing (40). As mentioned, snap fitments may be used to achieve this connection. A current source (31) is housed in the current source housing (30). If desired, user access may be provided to the current source. This may be done to allow a user to replace a depleted current source. In one embodiment, the entire current source housing may be detachably attached to the printed circuit housing, such that a manually applied force can separate the components. Once the current source is replaced, the parts may be manually press fitted together. In another embodiment, a portion of the current source housing opens to provide access. For example, the proximal end of the current source housing may unscrew or otherwise detach from the rest of the housing. Furthermore, the current source housing may be provided with a window (35) which allows an LED indicator to shine through, indicating that electrical current is flowing. Preferably, the current source housing has such a window.

The current source provides electrical energy to a resistive element that generates heat. Preferably, the current source comprises a DC power supply. In the preferred embodiment, the DC power supply is one or more batteries. Common household batteries, such as those used in flashlights and smoke detectors, selected to provide the resistive element with the proper current and voltage, are preferred. These typically include what are known as AA, AAA, C, D and 9 volt batteries. Other batteries that may be appropriate are those commonly found in cell phones, hearing aides, wrist watches and 35 mm cameras. The present invention is not limited by the type of chemistry used in the battery. Examples of battery chemistry include: zinc-carbon (or standard carbon), alkaline, lithium, nickel-cadmium (rechargeable), nickel-metal hydride (rechargeable), lithium-ion, zinc-air, zinc-mercury oxide and silver-zinc chemistries.

Other sources of DC current include solar cell technology, as found in many handheld devices, for example calculators and cell phones. According to this embodiment, one or more light collecting portions are located where sunlight or artificial light may shine on it. For example, the light collecting portions may be located on the outside surface of the handle, parallel to the axis of the handle. When light impinges the light collecting portions, the light energy is converted to electrical current for supplying the resistive element, via well known light cell technology. Optionally, a storage cell may be provided to store any unused electrical energy created by a photo cell, which may later be used to supply the resistive heating element, as for example when the lighting is too dim to create an adequate photo-current for the heating element.

The current source (31) comprises positive and negative terminals. Electrical current flows out of the current source at the positive terminal (32) and returns to the current source at the negative terminal (33). When the current source (i.e. a battery) is positioned within the current source housing, then the negative terminal (33) of the current source is in electrical contact with a negative lead (34). The negative lead facilitates flow of electricity from the printed circuit to the current source and may be fashioned as part of or be attached to the interior of the current source housing. "Electrical contact" means that, in a closed circuit, current will flow between the parts mentioned, regardless of any number of intervening parts.

Figure 6:
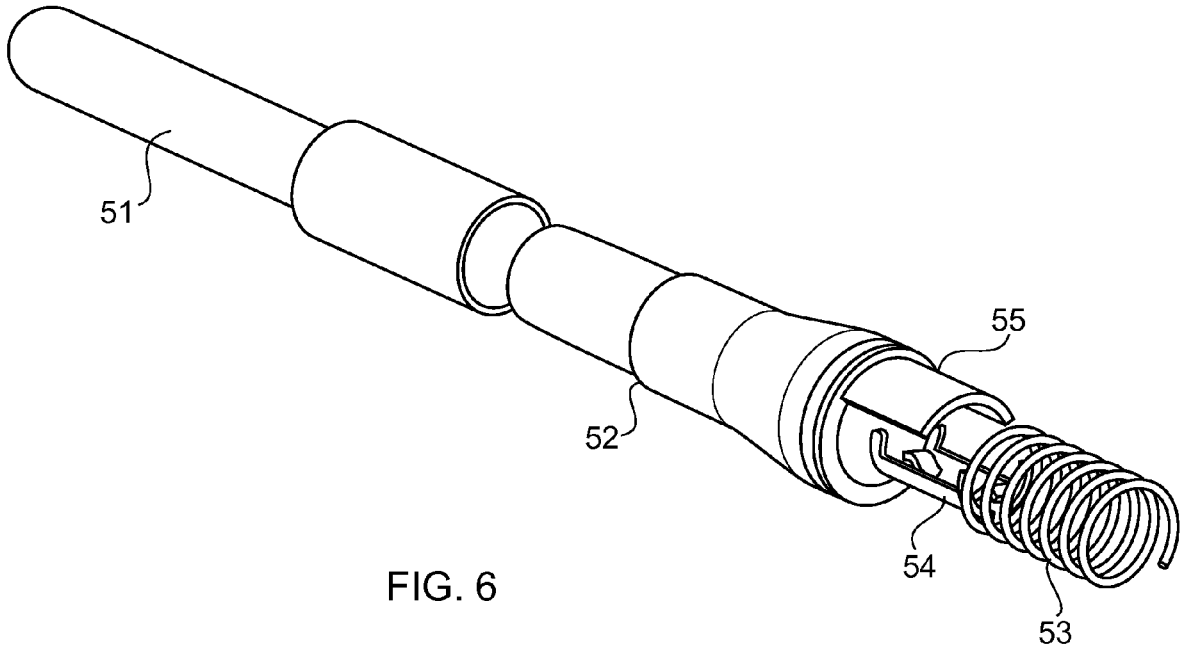
FIG. 6 is an exploded view of the switch assembly.

FIG. 6 is an exploded view of the switch assembly (50). The four main parts of the switch assembly are the conductive tip (51), the piston (52), the spring (53) and the sliding contact (54). A distal portion of the piston contacts a proximal portion of the conductive tip. For example, a distal portion of the piston may insert into a proximal portion of the conductive tip, up to a certain length of the conductive tip (see FIGS. 7*a* and 7*b*). A proximal portion of the piston (52) is received into a distal portion of the printed circuit housing (40). The piston slides within the printed circuit housing and maintains contact with the printed circuit housing. This contact is such that a liquid tight seal is maintained between the piston and the printed circuit housing. Preferably, the piston is a molded plastic part.

The switch assembly (50) is hollow and capable of receiving a distal portion of the printed circuit subassembly (60). The printed circuit subassembly emerges from the printed circuit housing and enters the switch assembly. The printed circuit subassembly reaches into the conductive tip (51) so that the heat generating portion (69) is adjacent to the conductive tip. The conductive tip readily conducts heat so that as little heat as possible is lost in transmission through the conductive tip. The conductive tip may be molded of plastic to a thinness that conducts heat with little heat loss or it may be metallic. The sliding contact (54) rests on the interior of the piston (52) and is fixed relative to the piston such that, when the piston slides within the printed circuit housing, the sliding contact moves with the piston. The sliding contact may be secured to the piston by fastener or adhesive, or the sliding contact may be bounded between fitments that prevent translation of the contact relative to the piston. The sliding contact comprises two ends that contact the printed circuit subassembly (60). The sliding contact is capable of conducting electricity between these two ends and depending on the position of the these two ends on the printed circuit, the electrical circuit will be closed or opened. Preferably, the sliding contact is metallic.

Figure 7A:
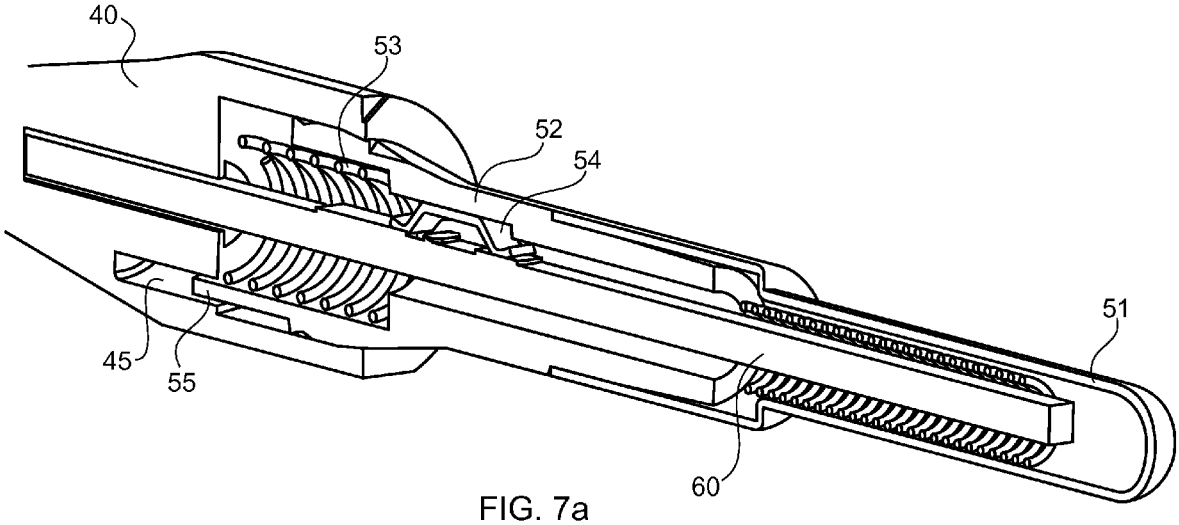
FIG. 7*a* is a cross section of the switch assembly in the on position, in cooperation with the printed circuit subassembly and the printed circuit housing.
Figure 7B:
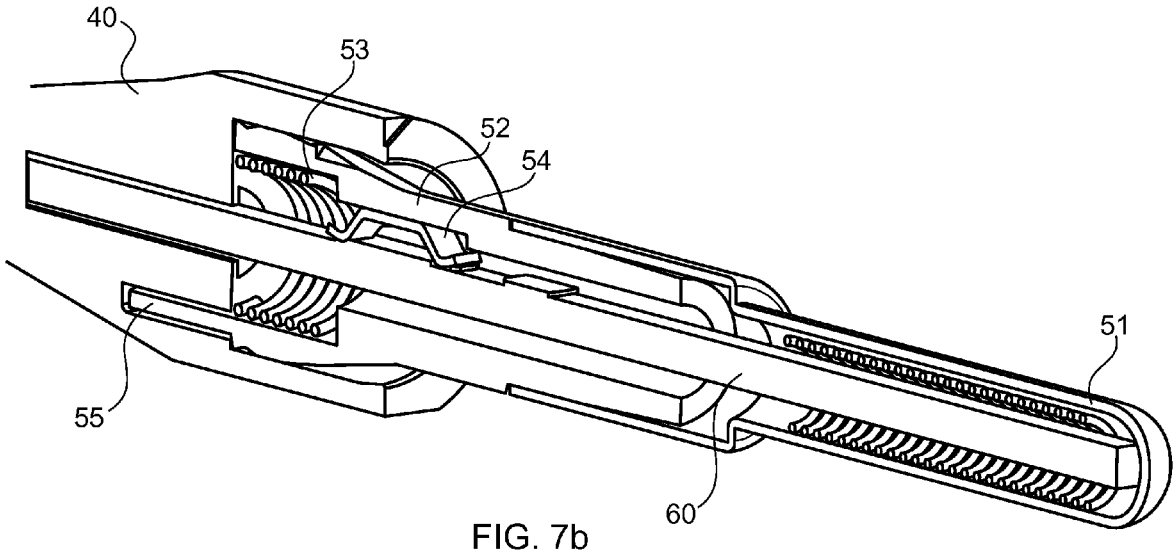
FIG. 7*b* is a cross section of the switch assembly in the off position, in cooperation with the printed circuit subassembly and the printed circuit housing.

A proximal portion of the spring (53) rests against the printed circuit housing (40) and a distal portion of the spring rests against the piston (52). When compressed, the spring exerts force on the piston, urging the piston toward the distal end of the device. Preferably, the distal portion of the spring is received into the proximal portion of the piston. When an axial force is directly applied to the conductive tip (51), the conductive tip, piston and sliding contact (54) travel toward the proximal end of the device, whence the spring is compressed and the electrical circuit is opened (FIG. 7*b*). When the directly applied force is removed, then the spring urges the conductive tip, piston and sliding contact toward the distal end of the device, whence the electrical circuit is closed (FIG. 7*a*). The spring may be any plastic or metal or may be replaced with any urging means that stores potential energy when the piston pushes against it.

An optional indexation (55) depends from the proximal end piston. If the indexation is provided, then an indexation groove (45) is provided in the printed circuit housing as shown in FIGS. 3, 7*a* and 7*b*. The indexation and indexation groove ensure proper alignment of the switch assembly and printed circuit subassembly. Preferably, means such as the indexation and indexation groove are provided.

A closure (70) is provided that fits over the applicator tip (20) and fixes, in a detachable manner, to the device. The closure may snap fit or have a screw engagement with the body (10). In the embodiment of the figures, the closure secures to the applicator tip by friction fit. The interior of the closure is provided with a pintel (71) positioned to enter the exit orifice (23) of the applicator tip and push against the conductive tip (51) of the switch assembly (50) (see FIGS. 2 and 3). Thus, removing the closure from the device closes the electrical circuit and heat is generated as long as the closure is off. Replacing the closure opens the electrical circuit and shuts off heat generation. In this way, the device is less likely to be left on unintentionally.

Raising the temperature of a product depends on the rate of heat generation within the heat generating portion (69) and on the rate of heat transfer through the conductive tip (51). These must be sufficient to raise the product from an ambient temperature to an application temperature. Product application temperature is that temperature or range of temperatures, for which a particular product having a particular application is effective. The present invention encompasses product application temperatures at least in the range of 40° F. to 120° F. The low end of this range is intended for products that may be used in cold environments, where raising the product temperature up to 40° F. may be sufficient to activate the product. At the other end, products raised beyond about 120° F. may be too hot for cosmetic and skin care applications. However, where it may be beneficial, there is, in principle, nothing about the device of the present invention that limits the product application temperature to 40° F. to 120° F. In conventional cosmetic use, a product temperature of about 95° F. often provides a pleasant application for the consumer, while a product temperature below about 85° F. may seem tepid and somewhat unsatisfying. In each specific situation, the optimum product temperature will depend on the physical characteristics of the product being applied. Parameters like texture, viscosity, pH, etc. will generally be considered in determining the optimum product application temperature. It is within the scope of a person of ordinary skill in the art to determine by trial error, a suitable product application temperature. It is also within the scope of a person of ordinary skill in the art to determine, by trial and error, a rate of heat transfer to the product that is sufficient to alter one or more physical characteristics of the product. For example, it may be desirable to provide a product which, at ambient conditions in the reservoir (15), is relatively inactive. In this case, the heat generating portion may be selected such that the rate of heat transfer into the product is sufficient to activate the product at the time of application.

Due to heat losses to the environment in the space between the heat generating portion (69) and the product and due to heat losses from the product surface to the ambient atmosphere, the heat generating portion must be capable of temperatures that are higher than the desired product application temperature. The rates of heat generation and transfer required for the specific product application can be worked out from basic thermodynamic principles and/or may be verified by routine experimentation. The temperature of the applicator tip (20) is another consideration, because the tip may contact the skin during use. Thus, it is preferable to achieve the desired product application temperature while keeping the temperature of the tip below about 120° F., or even better, below about 115° F.

For a wide range of applications, the applicator tip (20), heat generating portion (69) and current source (31) as herein described, are capable of achieving the necessary rate of heat generation and heat transfer. Preferably, these rates are sufficient to raise the temperature of the product in a reasonable amount of time. A reasonable amount of time is a time that does not frustrate the consumer by having to wait too long before using the heated applicator. This will vary depending on the specific application and the expectations of the consumer. For example, for a consumer making a cosmetic application, a reasonable amount of time may be less than one minute, preferably less than ten seconds and most preferably less than about five seconds. By heating the product quickly, the consumer is assured of applying only heated product. Optionally, the electronic circuitry may include a means for sampling the temperature of the applicator tip or of the product in the applicator tip and a means of providing the user with an indication that the product has reached a certain temperature or is ready to be applied or needs more time. For example, the applicator tip may be fashioned of a thermochromic material that changes to a certain color when a specific temperature is reached. Optionally, the printed circuit subassembly (60) may include means to adjust the rate at which electric power is converted into heat. For example, a rheostat operable by a user, may be provided in a manner known in the art.

Figure 8:
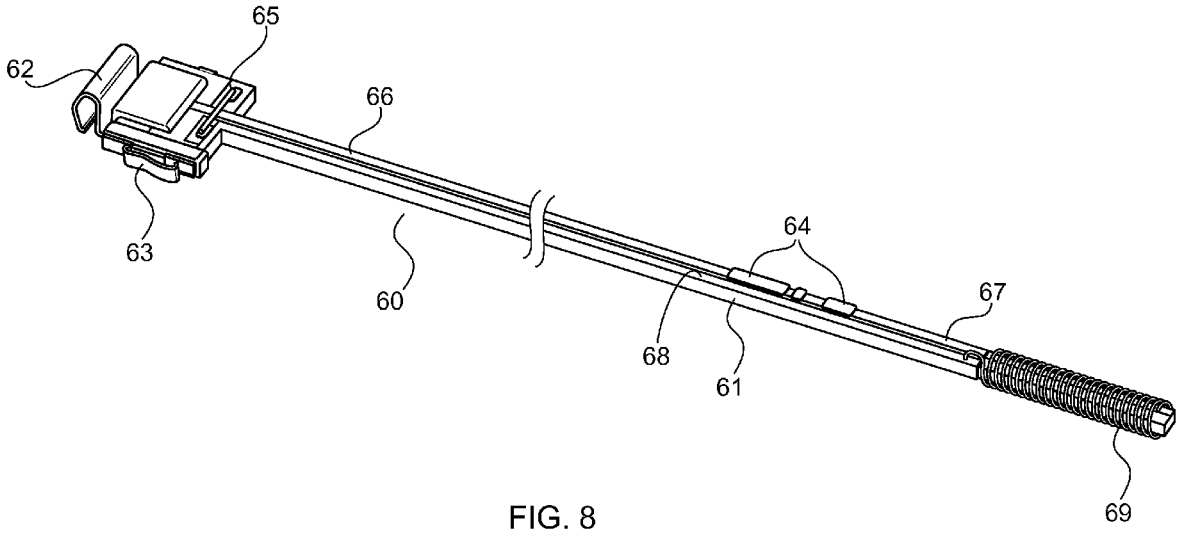
FIG. 8 is a perspective of the printed circuit subassembly.

Referring to FIG. 4, the circuit subassembly (60) extends from inside the current source housing (30), through the circuit housing (40) and into the applicator tip (20). Turning to FIG. 8, the circuit subassembly comprises a substrate (61) that is non-conductive to electricity and that supports various electrically conductive elements, which elements form a portion of an electric circuit. Suitable substrate materials include, but are not limited to, epoxy resin, glass epoxy and Bakelite (a thermosetting phenol formaldehyde resin). The substrate is preferably about 0.5 to 2.0 mm thick. Portions of one or both sides of the substrate may be covered with a layer of copper, say about 35 μm thick. In a preferred embodiment of the invention, the circuit subassembly is implemented as a printed circuit, according to printed circuit technology known in the art of printed circuits. In this embodiment, various conductive elements are printed on the substrate. These printed elements, in combination with the positive and negative terminals (32, 33), sliding contact (54) and heat generating portion (69), form a closed circuit. A circuit supported on a substrate, as thus described, is flexible to a more or less degree, depending on the exact thickness of the substrate and the flexibility of the heat generating portion.

The heat generating portion (69) may also be printed on the substrate (61). However, in a preferred embodiment, the heat generating portion is separate component, preferably at least as flexible as the substrate. In the figures, the heat generating portion is shown as winding of round resistive wire. This is a potentially effective, yet disadvantaged heat generating portion. The winding provides an amount of heat generating surface area that is sufficient to raise the temperature of the product, however, the winding is long and the generated heat is diffused over a relatively large area, heating a relatively large volume of product. We could say that this heat generating means is not targeted. As a result, heating time before application is greater than it would be if a more targeted heat generating portion was available. Also, the simple winding of round wire tends to limit the flexibility of the circuit subassembly.

In contrast, there is a general class of heaters known as "flexible heaters", originally designed for the aerospace and defense industries, where applications included maintaining constant temperatures in the instrumentation of aircraft, satellites, navigation, guidance and radar equipment, but many other uses outside of aerospace have since been discovered. Advantageous characteristics of flexible heaters include their light weight, thin profile and flexibility. Also, theses heaters can be configured into virtually any pattern to provide targeted heat concentration. Complex shapes, contours and three-dimensional patterns are possible. One example of flexible heaters are those supplied by Ogden Manufacturing Co. of Pittsburgh, Pa. A preferred flexible heater is supplied by Minco Products, Inc (Minneapolis, Minn.) under the name Thermofoil™. Thermofoil™ heaters and their equivalent offer a significant number of advantages over wire-wound resistive elements. According to Minco's website, "Thermofoil™ heaters are thin, flexible heating elements consisting of an etched foil resistive element laminated between layers of flexible insulation." Further, "Thermofoil™ heaters put heat where you need it. You simply apply them to the surface of the part to be heated. Their thin profile gives close thermal coupling between the heater and heat sink. You can even specify profiled heat patterns with higher watt densities in areas where heat loss is greater." Further, "The flat foil element of Thermofoil™ heaters transfers heat more efficiently, over a larger surface area, than round wire. Thermofoil™ heaters, therefore, develop less thermal gradient between the resistive element and heat sink. Heaters stay cooler. The result is higher allowable watt densities, faster warm-up, and prolonged insulation life. Thermofoil™ heaters can safely run at wattages twice those of their wire-wound equivalents. Insulation life may be ten times greater." Thermofoil™ heaters are made with Kapton® (Dupont) which is a polyimide in sheet form. The advantages of a flexible heaters are uniquely suited the present invention, where the surface area to be heated is small and targeted, where fast warm-up is critical to marketplace success and where flexibility of the componentry improves the manufacturing and assembly process. Thermofoil™ heaters have excellent chemical resistance and very good sealing and air tightness properties, which means the heater may be submerged in water. Furthermore, due to its thinness (0.15 mm for example), a Thermofoil™ heater is so flexible that it may be rolled or contorted to fit into a tight or crowded space.

The present invention is novel and non-obvious over the prior art because nothing in the prior art suggests a topical product, integral applicator incorporating flexible printed circuit and flexible, targeted heater technologies.

The number and location of printed conductive elements can vary depending on the layout and complexity of the circuitry. A relatively simple, yet effective circuit is shown in FIG. 8. Positive electrode (62) is the first portion of the circuit subassembly (60) path, which is capable of receiving electric current from the positive terminal (32) of the current source, either through direct contact with the positive terminal or through an intervening conducting lead. FIGS. 2, 4 and 5 show direct contact between the positive electrode and a positive battery terminal. The positive electrode also has electrical contact with first printed circuit element (66), on the substrate (61). Optionally, a portion of the current flows through an LED (65), which LED acts as an indicator that the device is on. The LED and window (35) are positioned relative to each other such that light from the LED will be visible to a user. Preferably, the circuit subassembly comprises an LED. The LED may be welded directly to conducting portions of the substrate. The remainder of the current flows distally, along one edge of the substrate, down to a pair of spaced apart sliding contact terminals (64). The sliding contact terminals may be printed on the circuit or may be metal contacts secured to the substrate. The space between the sliding contact terminals does not conduct electricity. When the circuit is closed, the sliding contact (54) spans the space and simultaneously contacts both sliding contact terminals. When the circuit is opened, then the sliding contact is not in a position to conduct electricity from one sliding contact terminal to the other and no power reaches the heat generating portion. In a closed circuit, electricity flows along a second printed circuit element (67) down the edge of the substrate, where it passes into a heat generating portion (69). After exiting the heat generating portion, the current travels back toward the current source, along third printed circuit element (68) where it merges with the LED portion of the current. The electricity then passes into the negative electrode (63), which may also be implemented as a printed circuit element or as a separate conductor making electrical contact with the printed circuit. From the negative electrode, the current flows along the negative lead (34) of the current source housing (30, see FIGS. 4 and 5) and into the negative terminal (33) of the current source (i.e. battery), thus completing the circuit.

One advantage of the flexible printed circuit is that virtually any electric circuit can be reproduced as a printed circuit of significantly smaller dimensions. This benefit is even greater if the heat generating portion (69) is implemented as a thin profile, flexible, targeted heater. Therefore, sophisticated circuits which are too bulky to implement in a heated applicator device may be implemented on the printed circuit strips as described herein. As discussed above, the ability to add heat generating capability to a cosmetic applicator without substantially increasing the size of the applicator is a great advantage. Furthermore, the printed circuit substrate (61) shown in FIG. 8 has a high percentage of unused space. This means that even more conducting elements could be printed on it as desired, without increasing the physical dimensions of the applicator. This is unlike a conventional wire conductor circuits that quickly use up the available space and which require a relatively high percentage of space to remain unused. Also, regardless of how complex the printed circuit becomes, final assembly of the present invention is not affected because all of the added complexity is confined to the printed circuit substrate. This is unlike conventional wire conductor circuits where each additional circuit element must be assembled during final assembly of the applicator into the housing. The printed circuits of the present invention can be manufactured well in advance of their final assembly into the applicator housing. For the most part, it is not possible with conventional wire conductor circuits to build the electronic circuit in advance of assembly into a housing or body, because the housing is needed to support the circuit and aid in making electrical connections.

Printed circuits offer additional advantages as well, like the possibility of implementing the present invention with no or relatively few individual wire conductors. All or most of the electronics may be confined to the printed circuit subassembly (60) having a customizable, modular heat generating portion (69). Also, the substrate (61) of the printed circuit strip may be substantially rigid or flexible. Herein lies another advantage of the present invention. A flexible circuit strip can be assembled into an interior space that is other than straight. For simplicity, the printed circuit strip may be manufactured in a straight or linear configuration, but the flexibility of the strip allows the strip to be used in applicator housings of various shapes. Also, even if the printed circuit strip reposes linearly within the assembled applicator, a flexible strip may facilitate assembly of the strip into the applicator housing.

With the advantages of the flexible, printed circuit and further, with the advantages of flexible heater technology, a heat generating integral applicator that is as slim as a pencil, for example, may now be easily fashioned, and the cost of design, componentry and manufacture are minimal. In fact, the integral applicators of the present invention are less cumbersome and less complex that anything in the prior art that purports to do a similar job. In fact, the applicators of the present invention are uniquely suited to dispense readily flowable, heated products, unlike anything in the prior art.

In use, the closure (70) is removed from the applicator tip (20) and this action releases the spring loaded switch assembly (50). The movement of the switch assembly completes the electric circuit, sending power to the heat generating unit (69). Within seconds of completing the circuit, heat flows from the heat generating unit through the conductive tip (51) of the switch assembly and into the product immediately around the switch assembly. Within a reasonable amount of time, the temperature of the product rises from an initial or ambient temperature toward a final or application temperature. Upon reaching the application temperature, perhaps receiving a signal from a temperature indication means, the user presses on one or more flexible portions (14) of the body wall to urge heated product through the exit orifice (23). The heated product is applied in an indicated or self-directed manner. While the user applies the product, the circuit is closed so that heat continues to warm the product during application, lest the product cool before application is completed. Thereafter, if more product is needed, the user may again press the flexible portion of the wall and retrieve more heated product. Substantial heating of the product in the reservoir does not occur, as only product near the conductive tip is heated to any significant degree. During application, at the user's discretion, the rate at which heat is generated may be adjusted, if such means (i.e. a rheostat) have been provided. The user may opt to do this if the user feels that the temperature is not optimal or if the time to reach application temperature is too long. When finished, the user replaces the closure on the applicator tip. As a result of this, the pintel seals the exit orifice and presses against the switch assembly, thus opening the electric circuit. Other scenarios for using an applicator as described herein, may exist, and these examples are not intended to be exhaustive.

Figure 9:
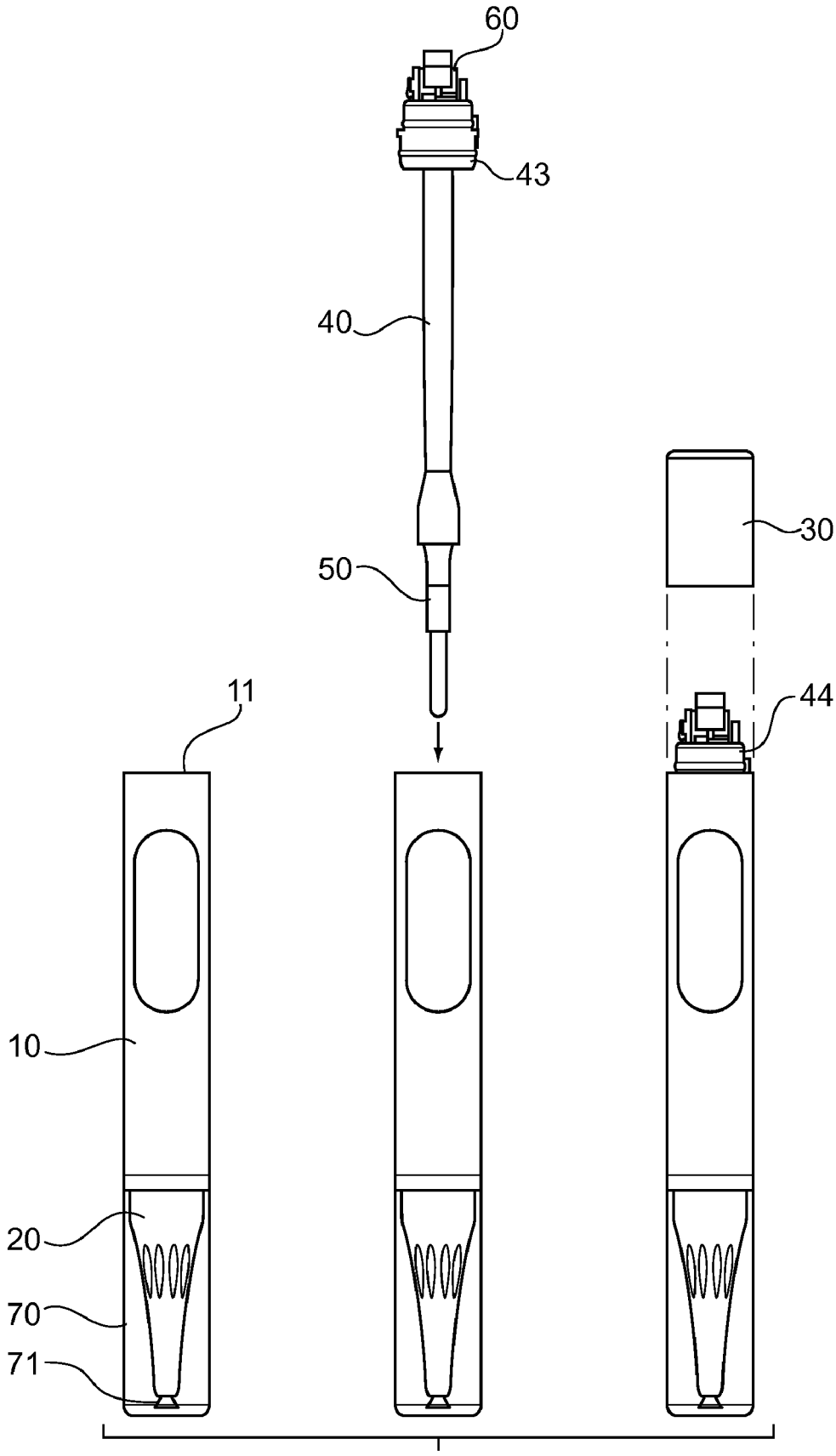
FIG. 9 is a schematic illustration of a filling procedure.

An integral applicator according to the present invention is easily filled (see FIG. 9). Preferably, the body (10), applicator tip (20) and closure (70) are preassembled. The pintel (71) of the closure will prevent leakage from the exit orifice (23) of the applicator tip (20). Also, the printed circuit housing (40), switch assembly (50) and printed circuit subassembly (60) with heat generating portion (69) are also preassembled. Through the proximal opened end (11), the body and applicator tip are filled to a level that will not overflow the body, when the combined switch-printed circuit subassembly is inserted into the body. The combined switch-printed circuit subassembly is inserted into the proximal opened end of the body until the annular flange (43) friction fits into the opened end. The insertion is aided by the indexation (55) and indexation groove (45) which ensure that the combined switch-printed circuit subassembly is properly rotated with respect to the body. Thereafter, the current source housing (30), having a current source (31) installed, is attached to annular flange (44) of the printed circuit housing.

The present invention is useful for applying cosmetic and dermatologic treatment products of all types, including products to treat skin, hair and nails. Suitable skin treatment products include those effective on the surface of the skin and those effective at deeper layers of the skin. Preferred products for use with the integral applicator described herein, are readily flowable either at room temperature or after being heated by a device according to the present invention. Readily flowable products can be efficiently evacuated from the reservoir and into the applicator tip by squeezing the flexible wall portions (14). Products that do not readily flow under there own weight or products that stick to the surfaces of the applicator will not evacuate as efficiently as readily flowable products, unless other urging means are provided. Discussed in detail herein, is a spot treatment, integral heating applicator for a readily flowable product. Modifications that achieve efficient evacuation of a non-readily flowable products may be apparent to those skilled in the art and such modifications are within the spirit of this invention.

What is claimed is:

1. A heat generating integral applicator that comprises:

a hollow body that defines a reservoir that contains a product, the hollow body comprising:

a wall, at least a portion of which is flexible;

and proximal and distal opened ends;

a hollow applicator tip having:

a proximal end attached to the distal end of the body; and a distal end that opens to form an exit orifice;

such that when the flexible portion is pressed, product is urged from the reservoir into the applicator tip;

a flexible, printed electronic circuit subassembly disposed within the body and disposed within the applicator tip, that comprises a heat generating portion and that is capable of electrical contact with a current source; and an on-off switch.

2. The applicator of claim 1 wherein the applicator tip comprises a working portion on the outer surface of the applicator tip, immediately adjacent to the exit orifice.

3. The applicator of claim 2 wherein the working portion is shaped for applying product to the eye area, the face, the arms or the legs.

4. The applicator of claim 2 wherein the working portion is textured to facilitate pick up and delivery of product.

5. The applicator of claim 4 wherein the applicator tip is flocked.

6. The applicator of claim 1 wherein the printed electronic circuit subassembly is disposed in an elongated printed circuit housing that extends through the body, the printed circuit housing having a proximal opened end and a distal opened end.

7. The applicator of claim 6 wherein the printed circuit housing comprises first and second annular flanges near its proximal end, and wherein the first annular flange attaches to the proximal opened end of the body.

8. The applicator of claim 7 further comprising:

a current source housing attached to the second annular flange of the printed circuit housing; and a current source disposed within the current source housing.

9. The applicator of claim 8 wherein the current source housing has a window.

10. The applicator of claim 9 wherein the printed circuit subassembly comprises an LED that is positioned to shine through the window.

11. The applicator of claim 8 wherein the current source housing provides user-access to the current source.

12. The applicator of claim 11 wherein the current source is comprised of one or more DC batteries.

13. The applicator of claim 6 further comprising a switch assembly, which is partially disposed in the distal end of the printed circuit housing and which receives into it a portion of the printed circuit subassembly.

14. The applicator of claim 13 wherein the switch assembly comprises:

a heat-conductive tip having the heat generating portion in its interior;

a piston that is attached to the heat conductive tip and that is slidable toward and away from the exit orifice;

a spring that biases the piston and conductive tip toward the exit orifice; and an electrically-conductive sliding contact that is fixed relative to the piston.

15. The applicator of claim 14 wherein the sliding contact touches the printed circuit subassembly at two points and is capable of assuming a circuit open position and a circuit closed position, relative to the printed circuit subassembly.

16. The applicator of claim 15 further comprising a closure that has a pintel depending from the interior of the closure, such that, when the closure is applied over the applicator tip, the pintel enters the exit orifice of the applicator tip and pushes against the heat-conductive tip, thus causing the siding contact to move from the circuit open position to the circuit closed position.

17. A method of applying a heated cosmetic product to a surface comprising the steps of:

providing an integral applicator according to claim 16, such that:

the closure is positioned over the applicator tip;

the applicator contains a flowable product; and the printed circuit subassembly is connected to a current source;

withdrawing the closure from the applicator tip;

waiting for a portion of product in the applicator tip to reach an application temperature;

squeezing the flexible portion of the body; and applying the product to the surface.

18. The method according to claim 17 wherein the steps of squeezing and applying are repeated.

19. The applicator of claim 1 having a product in the applicator tip and wherein the printed circuit subassembly generates heat at a rate that is sufficient to raise the temperature of the product from an ambient temperature to a product application temperature, in a reasonable amount of time.

20. The applicator of claim 19 that is capable of raising the temperature of the product in one minute or less.

21. The applicator of claim 19 wherein the product application temperature is between 40° F. and 120° F.

22. The applicator of claim 1 wherein the heat generating portion comprises targeted, flexible heater technology.

23. The applicator of claim 22 wherein the heat generating portion includes an etched foil resistive element.

* * * * *